United States Patent [19]

Bardenheuer

[11] Patent Number: 4,842,256

[45] Date of Patent: Jun. 27, 1989

[54] APPARATUS FOR MELTING METAL

[75] Inventor: Peter Bardenheuer, Düsseldorf, Fed. Rep. of Germany

[73] Assignee: KGT Giessereitechnik GmbH, Dusseldorf, Fed. Rep. of Germany

[21] Appl. No.: 181,182

[22] Filed: Apr. 13, 1988

Related U.S. Application Data

[62] Division of Ser. No. 23,392, Mar. 9, 1987.

[30] Foreign Application Priority Data

Mar. 25, 1986 [DE] Fed. Rep. of Germany ..... 3610498

[51] Int. Cl.[4] ..... C21B 13/02

[52] U.S. Cl. ..... 266/197; 75/43

[58] Field of Search ..... 266/197; 75/43

[56] References Cited

U.S. PATENT DOCUMENTS 3,802,678 4/1974 Taft ..... 266/197

*Primary Examiner*—Peter D. Rosenberg

[57] ABSTRACT

A process for melting metal in a shaft furnace operated without coke using a liquid or gaseous fuel, whose combustion products initially heat the molten metal which has collected below the furnace hearth (2) in furnace shaft (1) to the desired tapping temperature, followed by the introduction thereof into the furnace shaft for melting the metal. Furnace shaft and furnace hearth are separated by a water-cooled grid (6), which carries the charge introduced into the shaft. The flame temperature of burner (3) is controlled through preheating the combustion air. The combustion air is recuperatively heated by the waste gases of the shaft furnace. The heat transfer in the recuperator (4) is variable and can be influenced by the supply of cooling air to the waste gases prior to recuperation, by a controllable induced draft blower behind the recuperator and/or after-burning of the waste gases prior to the introduction thereof into the recuperator.

2 Claims, 1 Drawing Sheet

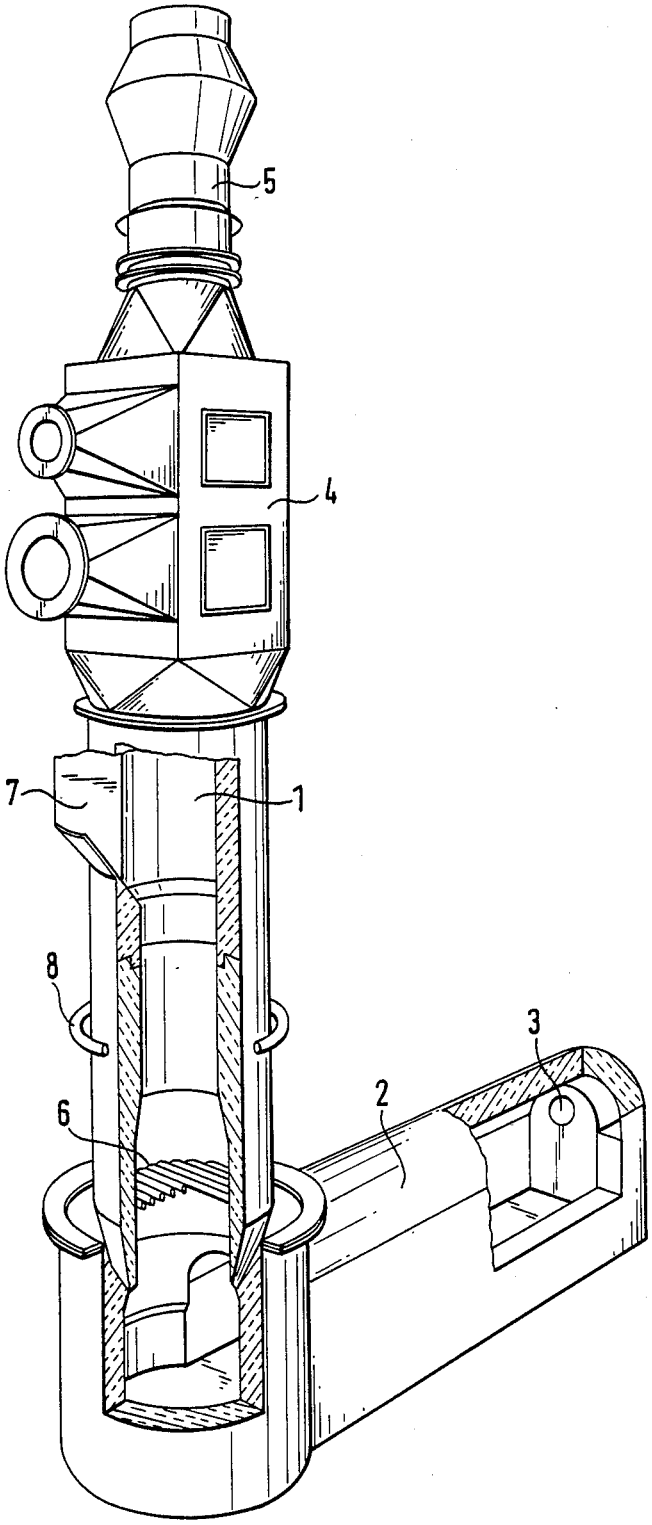
5
4
7
1
8
3
2
6

APPARATUS FOR MELTING METAL

This is a division of application Ser. No. 023,392, filed Mar. 9, 1987.

The invention relates to a process for melting metal in a shaft furnace using a liquid or gaseous fuel with a grid located at the lower end of the shaft furnace for supporting the not yet melted metal introduced into said furnace, which is melted by the combustion products passed from bottom to top through the shaft furnace and in this state collects below the grid, the oxygen-containing gas necessary for burning the fuel being prior to combustion.

BACKGROUND OF THE INVENTION

In conventional processes for melting metals, particularly iron or copper, Cupola furnaces are used with coke as the fuel. Processes are also known in which, a part from coke, fuels such as fuel gas, mineral oil or coal waste products are used. However, these processes suffer from the important disadvantage that the molten metal is contaminated by the use of coke as fuel, mainly by sulphur and phosphorus, or alternatively coke with the necessary quality is not available.

Therefore processes for melting metals in shaft furnaces are known in which coke not used as the fuel and the metal is instead melted with the aid of fuel gases such as natural gas, city gas, propane and butane, or mineral oils. These processes are advantageously characterized in that no contaminants or impurities are introduced by the fuel into the molten metal, because the contact time between the gaseous combustion products and the metal charge is relatively short.

Such a process is known from DE-AS No. 22 04 042, which describes a process for melting iron in a vertical shaft furnacne without the use of coke and using a fluid fuel/air mixture. This mixture is burned in burners outside the furnace and which are located close to the base of the furnace. Scrap iron and pig iron are fed into the upper end of the furnace and molten, superheated or overheated metal passes through a bed of loose refractory elements arranged within the shaft. Said elements are heated by the upwardly travelling combustion products of the burners before the combustion products melt the oncoming metal. The molten metal is tapped at the bottom of the furnace. The refractory elements forming the bed preferably comprise lime-bonded galena graphite. During the operation of the shaft furnaces, they are consumed in a quantity of 2% or less with respect to the weight of the molten iron, so that the furnace can only be operated for relatively short periods before the bed has to be completely replaced. The bed can be kept at its working depth, in that the bed material is fed into the introduced charge materials in a quantity of approximately 1 to 2% of the weight of the metal charge.

The article "Der kokslose giessereischachtofen" by W. Sachs, Giesserei 66, No. 12, 11.6.1979, pp 415 to 417 also describes a process for melting metal in a shaft furnace, in which use is made of a gaseous or liquid fuel. Balls of ceramic material on a water-cooled grate or grid are used as the superheating bed. Here again ceramic balls must be added to each charge to maintain the height of the superheating bed.

The article "Das Umschmelzen von Kupferschrott im Flaven-ofen" by Dr. H. P. Goossens in the journal ERZMETALL, vol 24, No. 3, March 1971, pp 105 to 107 also describes a shaft furnace operating without coke as the fuel material. The furance bed is held by a grid or grate made from water-cooled steel pipes, which on the one hand prevents the solid charge from dropping from the shaft furnace into the underlying hearth and on the other hand in counter flow ensures the through-flow of the hot combustion gases. The grid carries an approximately 20 cm high layer of highly refractory materials, e.g. corundum lumps or coke with limestone.

The three aforementioned known shaft furnaces, which do not use coke as the fuel, consequently have the common feature that in operation the bed material is necessary for superheating the melting charge and is subject to wear during the melting process. The need for a superheating bed results from the fact that the oxygen provided for burning the fuel has to be supplied substoichiometrically to ensure that there is no oxidation of the molten metal through unburnt oxygen. Therefore the combustion of the fuel is not complete, so that the flame temperature which can be reached is relatively low. Therefore for melting the metal the contact time between the latter and the material supplying heat thereto must be made as long as possible and the superheating bed fulfills this function. The ceramic materials of this bed are subject to slagging and coke is consumed through the gas component $CO_2$ and $H_2O$ via the Boudouard or water gas reactions. It is therefore necessary to constantly supply to the metal charges fed into the furnaces a new bed material quantity which compensates for wear.

When using ceramic or coke as the bed material there are relatively large amounts of slag, which impair the economics of the furnace, because a considerable energy proportion is required for heating, forming and superheating the slag. As a result of the relatively high weight of the bed materials, large and expensive amounts thereof are required. When using ceramic bed material it is subject to premature softening, because it is not resistant to attacks by slag.

The earlier-dated application No. P 34 37 911.8 describes a process for melting metal in a shaft furnace using a liquid or gaseous fuel, where the lower section of the furnace contains a separating and superheating bed for the metal, which is heated by the combustion products passed from below the bed upwards through the shaft furnace, so that the metal is melted and is collected in this state below the bed. The combustion air supplied to the burner is previously heated, said combustion taking place recuperatively through the waste gases of the shaft furnace. This raises the flame temperature of the burner and improves the economic operating characteristics of the shaft furnace. However, even this known process still requires a superheating bed and the flame temperature cannot be controlled by means of the degree of heating of the combustion air.

The problem of the present invention is therefore to improve the process disclosed in patent application No. P 34 37 911.8 in such a way that the desired temperature for the molten metal can be adjusted in a simple manner and can be achieved even without the use of a superheating bed.

BRIEF SUMMARY OF THE INVENTION

According to the invention this problem is solved by the feature that the temperature of the oxygen-containing gas is set prior to combustion, as a function of the desired temperature of the molten metal. Advantageous further developments of the inventive process and preferred apparatuses for performing it can be gathered from the description further below.

The invention is characterized in that the temperature of the oxygen-containing gas is set, prior to combustion, as a function of the desired temperature of the molten metal. The oxygen-containing gas can be heated recuperatively through the waste gases of the shaft furnace and its temperature can be set by controlling the rate at which the waste gases are drawn from the shaft furnace and/or through a controlled after-burning of the furnace waste gases prior to recuperation and/or by admixing cooling air with the furnace waste gases prior to recuperation. Thus, the temperature is set by a corresponding modification of system-internal parameters, so the melting process can be controlled in a simple manner. If the oxygen-containing gas is preheated to approximately 400° to 600° C., the flame temperature can reach at least 1800° C., which is sufficient to obtain e.g. molten iron with a temperature of 1450° C.

BRIEF DESCRIPTION OF THE DRAWINGS

The invention is described in greater detail hereinafter relative to an embodiment shown in the drawing, which represents a shaft furnace partly in view and partly in vertical section.

DETAILED DESCRIPTION OF PREFERRED EMBODIMENTS

The represented shaft furnace has a vertical furnace shaft 1 beneath which there is a horizontally extending furnace hearth 2. Into the latter issues a burner 3, which is connected to not shown supply lines for the fuel and combustion air. The combustion air supplied is previously preheated in a recuperator 4 located between the furnace shaft 1 and a chimney or stack 5 and through which flows the hot waste gases from the shaft furnace. A water-cooled supporting grid 6 is located between furnace shaft 1 and hearth 2 and carries the metal to be melted, which is fed into furnace shaft 1 via a charging opening 7. A filled bed can be formed directly on the supporting grid 6 and reduces impacts through the dropping down metal and consequently protects the grid against damage, whilst optionally also having a separating function for the melting metal. However, this filling bed does not influence the melting process.

The hot combutsion gases of burner 3 flow out of furnace hearth 2 into furnace shaft 1, so that metal melts over supporting grid 6 and drips through the latter. The molten metal collects on the bottom of hearth 2 and its temperature is maintained or even increased by the combustion gases flowing over it. Only the combustion air quantity is supplied to the burner 3 with respect to the fuel necessary for completely burning the oxygen contained therein. This measure is necessary, because otherwise there would be a risk of oxidation of the molten metal or any alloying additions. Therefore the thermal energy obtained from combustion alone is not generally sufficient to melt the metal without the use of a superheating bed.

As a result of the recuperative heating of the combustion air heat is supplied via burner 3 to furnace hearth 2 in addition to the combustion energy. This leads to an increase in the flame temperature, so that with a preheating of the combustion air to approximately 400° to 600° C., a flame temperature of approximately 1800° to 2000° C. is obtained. This flame temperature makes it possible to heat the molten metal to approximately 1450° to 1600° C., which represents the suitable tapping temperature for iron.

The waste gases leaving furnace shaft 1 have a temperature of approximately 1000° C. It is therefore possible to adjust the recuperative heating of the combustion air to a desired value within a wide range. This can take place automatically as a function of different measured parameters. Such parameters are e.g. the temperature of the molten metal and the temperature in the combustion chamber upstream of burner 3.

Various measures can be taken singly or in combination for setting the temperature of the preheated combustion air. One of these measures is the controlled supply of cooling air via a not shown opening into the upper part of shaft furnace 1, i.e. into the area between the metal to be melted and the recuperator 4. A further measure is the provision of a controllable induced draft blower in stack 5, which e.g. comprises an adjsutable throttle valve and a fan. This makes it possible to control the flow rate of the waste gases through recuperator 4, so that also the heat emission from the waste gases to the combustion air in the recuperator 4 can be influenced. As the oxygen required for combustion is supplied substoichiometrically, the fuel introduced via burner 3 is only incompletely burnt, so that the combustion gases e.g. still contain CO. By feeding air into the waste gases leaving the metal to be melted, it is possible to carry out after-burning, so that the waste gases are further heated and it is consequently possible to raise the temperature of the combustion air in recuperator 4. For this purpose a bustle pipe 8 passes round furnace shaft 1 and enables the oxygen required for after-burning to be introduced into the furnace shaft 1 though appropriate openings in its wall. These three measures offer the possibility of adjusting the temperature of the preheated combustion air over a wide range and in the desired manner. This makes it possible to also regulate the flame temperature to approximately 2000° C. for obtaining the desired tapping temperature of the molten metal.

I claim:

1. An apparatus for melting metal comprising: a shaft furnace having a vertical shaft, a grid located at a lower end of said shaft for supporting metal to be melted and introduced into said furnace, a horizontally extending hearth below said grid, a burner in said hearth, means for supplying a liquid or gaseous fuel to said burner, and means for supplying combustion air to said burner, the metal being melted by combustion products from said burner passed from bottom to top through the grid and shaft and collecting below the grid, and a stack above the shaft and equipped with a recuperator for preheating the combustion air in said means for supplying combustion air, and equipped with a blower for controlling the rate of draft of combustion products through said recuperator to thereby regulate the temperature of the combustion air.

2. An apparatus according to claim 1, comprising inlets for supply of an oxygen-containing gas into the furnace shaft above the grid.

* * * * *